US006899245B1

(12) United States Patent
Nelson

(10) Patent No.: US 6,899,245 B1
(45) Date of Patent: May 31, 2005

(54) CONTAINER WITH TAMPER RESISTANT LID

(76) Inventor: James L. Nelson, 3650 Dulles Dr., Mira Loma, CA (US) 91752

( * ) Notice: Subject to any disclaimer, the term of this patent is extended or adjusted under 35 U.S.C. 154(b) by 0 days.

(21) Appl. No.: 10/620,327

(22) Filed: Jul. 14, 2003

(51) Int. Cl.[7] ..... B65D 17/04
(52) U.S. Cl. ..... 220/276; 215/254
(58) Field of Search ..... 220/276, 265, 220/266, 269, 270; 215/254

(56) References Cited

U.S. PATENT DOCUMENTS

| | | | | | |
|---|---|---|---|---|---|
| 4,476,993 | A | * | 10/1984 | Krout | 220/276 |
| 4,718,571 | A | * | 1/1988 | Bordner | 220/270 |
| 4,934,554 | A | * | 6/1990 | Edwards | 220/266 |
| 5,115,934 | A | * | 5/1992 | Nelson | 220/276 |
| 5,249,694 | A | * | 10/1993 | Nelson | 220/276 |
| 5,271,517 | A | * | 12/1993 | Bowers | 220/276 |
| 5,540,342 | A | * | 7/1996 | Rathbun | 215/225 |

* cited by examiner

*Primary Examiner*—Lien M. Ngo
(74) *Attorney, Agent, or Firm*—Trojan Law Offices

(57) ABSTRACT

A container lid having a tamper evident and tamper resistant band formed of a plurality of equally spaced tabs having spurs that engage the rim of a container with latches formed on the spurs. In one embodiment the tamper evident band is unique because it hinges up instead of down and has a plurality of spurs with a stepped edge forming latches with the spurs engaging slots around the periphery of the lid. The reverse action makes the step edges on the spurs on the inside of tabs formed on the tamper resistant strip pull tighter when any attempt is made to pry or remove the lid from a container or cup. The lid also includes an annulus having interior surfaces that provide an excellent seal both inside and outside of the cup when the tamper resistant band is removed. In a second embodiment a tamper resistant band is formed with a curved surface to engage the exterior surface of the cup and has a plurality of spurs with a detent forming a latch to engage the lower edge of the skirt around the periphery of the lid. Each tab on the tamper resistant and tamper evident band has preferably two spurs.

9 Claims, 4 Drawing Sheets

CONTAINER WITH TAMPER RESISTANT LID

BACKGROUND OF THE INVENTION

1. Field of the Invention

This invention relates to containers with tamper resistant lids and more particularly relates to a container having a tamper resistant lid with a tear strip secured by latches formed on spurs on the tear strip.

2. Background Information

In recent years, package tampering has resulted in many methods being conceived to protect against tampering and indicate when tampering has occurred. These methods include products sealing and container will make container tamper evident. Any tampering with the seals on the container will be readily apparent so that potential user will be warned. Present methods have achieved some modicum of success but a disadvantages that they are not as secure as they could be and are in some cases costly to use.

One such container having a plastic lid has sections that are easily ruptured to remove the lid. Any attempt to force the lid off the container will rupture these section and provide evidence of tampering. However, this system can be defeated by slow, tedious prying of the lid a small section at a time, until a lid is removed without rupturing the tamper evidence seal.

Another method known of sealing containers is to provide a heat shrinkable plastic seal around the opening and over the container lid. However, this system can be defeated by warming the heat shrinkable sleeve and slowly stretching it until it can be easily removed. It can then be replaced and heat shrunk back over the cover after the product in the package has been tampered with. The container will then look like the seal has remained intact.

Another disadvantage of the present products is that the more secure they are the more difficult it is to open them and gain access to the contents of the container. For example the latter container with the heat shrinkable sleeve is sometimes so secure that it requires a knife to cut them away. Users have been injured by stabbing or cutting themselves trying to remove the seal.

Still another method of sealing and protecting containers is to provide a thin foil covering the mouth of the container beneath a lid. This too, while effective, has its disadvantages. The seal foil of film is covered by the lid losing the visual affect of a secure package. Another difficulty with this type of arrangement is that it is also difficult to remove and sometimes requires a cutting instrument to pierce the seal.

Thus it is apparent that while the present methods are effective, they have disadvantages in that they can be defeated or if very secure, they are difficult to remove.

Another method of sealing containers is disclosed and described in U.S. Pat. No. 5,115,934 issued May 26, 1992 to the same inventor as that of the invention disclosed herein. This seal has been very effective and provides a tear-away strip that cannot be easily removed without evidence of tampering. The tear-away strip is comprised of a plurality of tabs joined by integral thin film links that are heat shrinkable. The lid with this tear-away strip is mounted on a container and the tear strip folded or pressed down beneath the lip of the container. Heat is then applied to the strip to shrink the thin film links securing the lid on a container. The thin film links are a very secure method of providing evidence of tampering because it is nearly impossible to remove the lid without rupturing one or more of these links. However, this method of protecting containers is costly and requires special machinery for mounting the lids on containers. The lids must first be put on the containers and rolled to fold the tear-strip down around the periphery of the container and then heated to shrink the think film links. Thus in addition to the cost of manufacturing the lid, the method of putting the lids on the containers add to the cost of the procedure.

It is therefore one object of the present invention to provide a tamper resistant lid similar to the lid disclosed in the above identified patent that is very secure. It this container, a tear strip is provided that is extremely difficult to remove without rupturing one or more sections of a tear-strip mounted on the lid.

Another object of the present invention is to provide a container lid that has a tear strip that is very secure but is also easy to remove by a user. The tear strip is secured to the lid container by placing the lid on the container and folding the tear strip beneath the rim of the container to lock the tear strip on the lid.

Still another object of the present invention is to provide a tamper resistant container lid that is easy to open by using a pull tab on a tear strip that allows the tear strip to be easily stripped from the lid to gain access to the contents of the container.

Yet another object of the present invention is to provide a container with a tamper resistant lid that is secure, easy to open and also will provide a good, secure closure after a tear strip has been removed.

Yet another object of the present invention is to provide a container with a tamper resistant lid having a tear strip that is easily and quickly mounted on a container.

Yet another object of the present invention is to provide a container with a tamper resistant lid having a tear strip with a plurality of tabs around the periphery of the lid having latches formed on the tabs that engage slots in a flange on the lid to secure the lid on a container.

Yet another object of the present invention is to provide a container with a tamper resistant lid having a tear strip around the periphery of the lid formed with a plurality of tabs having multiple latches that engage a flange on a lip of the container securely fastening the lid on the container.

BRIEF DESCRIPTION OF THE INVENTION

The purpose of the present invention is to provide a container with tamper resistant lids that are extremely secure but may be easily removed to provide access to the contents of the container.

The purposes of the present invention is achieved by providing a lid with a tear strip secured around the periphery of the lip of the container. The tear strip is secured around the periphery of the lid on a lip or skirt which forms an annulus for mounting the lid on the rim of a container. The tear strip is secured to the periphery of the flange on the lid by a thin section of material forming a hinge. Two embodiments of the tear strip are disclosed herein and are improvements on the method disclosed and described in U.S. Pat. No. 5,115,934 issued May 26, 1992 to the same inventor as the invention disclosed herein and is incorporated herein by reference. The same secure attachment of the lid to the container is achieved but without the need for the heat shrinkable links which add an extra step in manufacturing and mounting the lid on the container.

There are two embodiments conceived to replace the heat melt tamper resistant tear strip called a zipper lid or Z-lid. In one embodiment the lid appears to be similar but works quite differently in that the tear strip hinges up instead of down and protrudes through the side wall of the lid. This reverse action makes contact with the lip and pulls up tighter into the lid side wall when an attempt is made to remove it or pry it from the cup. Also, this tamper resistant strip lid seals the inside and outside of the cup to make an excellent seal. The sealing surfaces still maintain an excellent seal with or without the tamper resistant tear strip.

Because the tamper evident tear strip or band is locked into place and is protected with small bumps or steps around the outside edge forming latches and its reverse action to keep in place, there is no need for the heat links of the zipper lid between the tabs or flaps. This elimination of the heat links makes the manufacturing of the lid simpler and eliminates the need for a heating unit in the lid mounting or capping machine.

In this lid the tamper evident seal is comprised of a plurality of tabs or flaps equally spaced around the periphery of the lid having spurs on the underside. These tear strips are attached to the lower edge of a lip around the periphery of the lid with a thin section of material providing a hinge that will easily fracture when a moderately lateral force is applied to a pull tab on the end of tear strip. The spurs on the underside of the tabs on the tear strip are constructed to engage a plurality of equally spaced slots in the peripheral lip or skirt on the lid and have an edge that has a plurality of steps forming small bumps or latches that lock the tear strip onto the peripheral lip of the lid. The tear strip is attached to the lower edge of the lid with the spurs and stepped edge on the outside so that the tear strip hangs downward and because it hinges up instead of down is pressed into place by rolling it upward.

In addition the lid seals both on the inside and outside of the cup or container providing an excellent seal. The lower inside peripheral edge of the skirt or lip on the lid has a ridge that fits over a flange on the rim of the cup or container and an inside surface that fits inside and engages the inner periphery of the container. The lid has an annulus beneath the skirt that is mounted by pressing it down guiding the container into the annulus then folding the tear strip upward so that the spurs and the stepped edges engage the slots in the lid. This locks the tear strip in place around the periphery of the cup or container. A surface adjacent the ridge in the annulus securely engages an outer surface of the flange on the rim of the container. These surfaces in the annulus under the lid skirt provide a secure, tight seal with or without the tamper resistant band or strip on the lid.

Another optional embodiment of the invention is a lid having a tear strip similar to that shown on the zipper lid in the patent referred to hereinabove in which the tear strip has a plurality of tabs having a curvature that fits below the flange on the rim of the container or cup and the peripheral lip or skirt on the lid. Each tab preferably has a pair of spurs with a detent on an edge adjacent the underside of each tab that serves as a latch to engages the bottom of the lower edge of the lip on the container lid to lock the tear strip in place on the container. This lid also includes a peripheral ridge in the annulus formed on the underside of the skirt on the lid that engages a lower edge of a peripheral flange on the container as well as a mating surface that engages in interior upper, peripheral interior surface on the container to provide an excellent seal. As in the earlier embodiment, a second surface adjacent the annulus beneath the lid skirt adjacent the locking ridge provides a seal against a surface on flange around the rim of the container. Thus the lid maintains a tight seal both inside and outside with or without the tamper resistant tear strip on the container.

The tamper resistant tear strip is attached to the lid by a thin section of material to the lower-edge of the skirt providing a hinge that will easily fracture when a moderate lateral force is applied to a tab on the tear strip. The lid is mounted on the container by pressing it down on the container then rolling it in a capping or mounting machine to roll the tear strip downward so that the spurs having the detents are fit beneath an edge on the peripheral flange of the container until the detents lock or latch on the lower edge of the flange.

The above and other objects, advantages, and novel features of the invention will be more fully understood from the following detailed description and the accompanying drawings, in which:

DETAILED DESCRIPTION OF THE INVENTION

Figure 1:
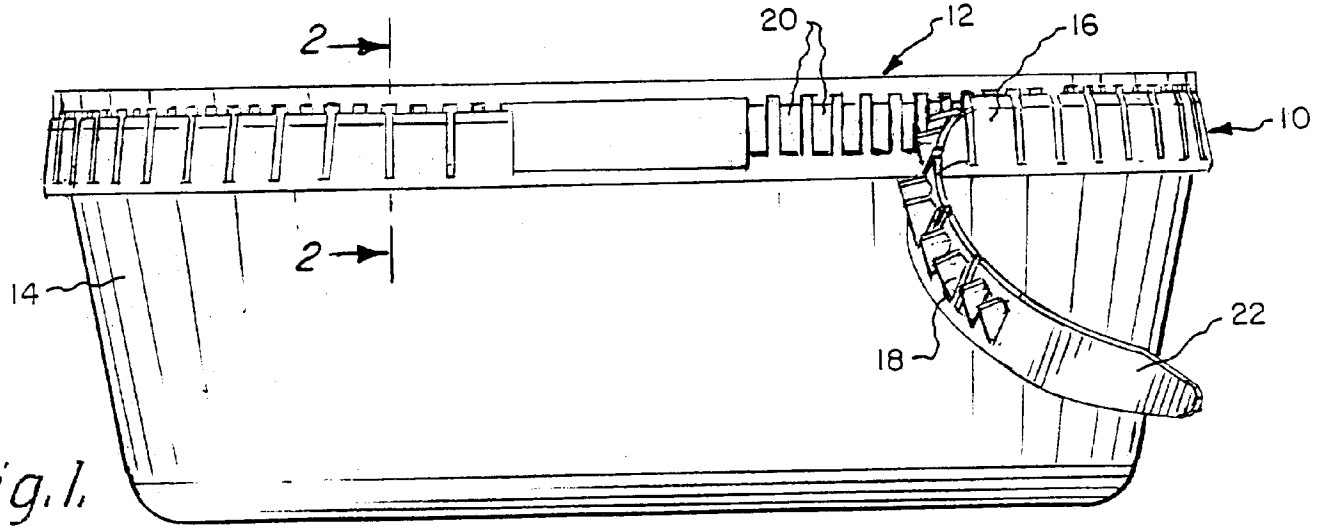
FIG. 1 is a side elevation of a container having a tamper resistant tear strip with a locking mechanism that includes a spur with a plurality of steps forming bumps that engage slots in the peripheral skirt on a container lid.

One embodiment of the invention is illustrated in FIGS. 1 through 5 in which the tamper resistant or tamper evident tear strip 10 is mounted on a peripheral lower edge of a skirt of a container lid and is unique because it locks by folding it up rather than down. Tamper evident tear strip 10 is shown on lid 12 mounted on cup or container 14. Tamper resistant tear strip 10 is separated into a plurality of equal spaced and equal sized tabs 16 having spurs or lugs 18 on one side for engaging slots 20 in the peripheral skirt of lid 12 as will be in greater detail hereinafter. Tamper resistant tear strip 10 is removed from a sealed container by gripping finger pull tab 22 and applying a lateral force. The arrangement shown provides an easily removed tamper resistant tear strip while at the same time providing a very secure lid that looks similar but works quite differently from the zipper lid disclosed and described in U.S. Pat. No. 5,115,934 of the same inventor as the invention disclosed and described herein and incorporated herein by reference.

Lid 12 and tamper resistant tear strip 10 work quite differently in that the tear strip hinges up instead of down and protrudes through slots 20 in a sidewall of skirt 24 on lid 10. This reverse action makes the container lip pulls hooks or latches on spurs 18 tighter into the lid sidewall when any attempt is made to remove it or pry it loose from cup or container 14. Lid 12 also seals both to the inside and outside of a cup 14 to provide an excellent seal that is effective with or without the tamper resistant tear strip 10. Because tamper resistant tear strip 10 is locked into place and protected with small steps or bumps forming latches around an outside edge and its reverse action keeps it in place, there is no need for the heat shrinkable links between each tab as described in the above identified patent. This simplifies the manufacturing process and eliminates the need for heating when mounting lids in a capping or lid mounting machine.

Figure 2:
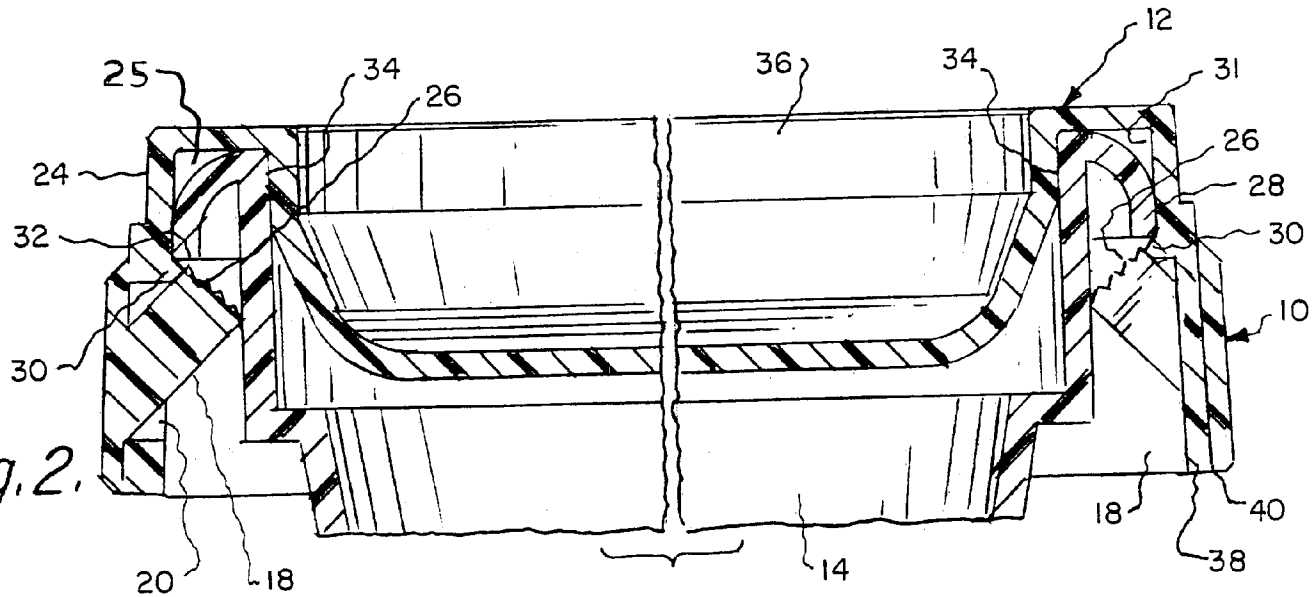
FIG. 2 is a sectional view taken at 2—2 of FIG. 1.

The detailed construction of lid 12 and tamper resistant strip 10 is shown in greater detail in FIG. 2. In this figure, tamper resistant tear strip 10 is shown folded up with spurs or lugs 18 engaging slots 20 equally spaced around the peripheral skirt lip 24 of lid 12. Each spur or lug 18 is provided with stepped surface 26. The stepped section 26 of spurs or lugs 18 plus the reverse action of tear strip 10 cooperate with the container lip to pull the hooks formed by the stepped section 26 tighter into the lid sidewall when any attempt is made to remove or pry tamper resistant tear strip 10 and lid from cup 14. Any attempt to remove lid 12 without first removing tamper resistant tear strip 10 causes hooks formed by stepped section 26 to catch on the peripheral flange 28 of cup or container 12 forcing the lid more tightly on the cup.

An additional feature of the invention is the formation of a tight seal by lid 12 both inside and outside container 14. Skirt 24 on lid 12 form an annulus 25 with surfaces 31 and 34 that mate with interior and exterior surfaces of cup or container 14. Ridge 30 engages the lower edge 32 of flange 28 on cup 14 while an inner surface 34 in annulus 25 guides cup or container 14 up into the lid and seals the container like a plug. Sealing surfaces 31 and 34 on lid formed in annulus 25 and on peripheral straight, recessed section 36 of lid 12.

Figure 3:
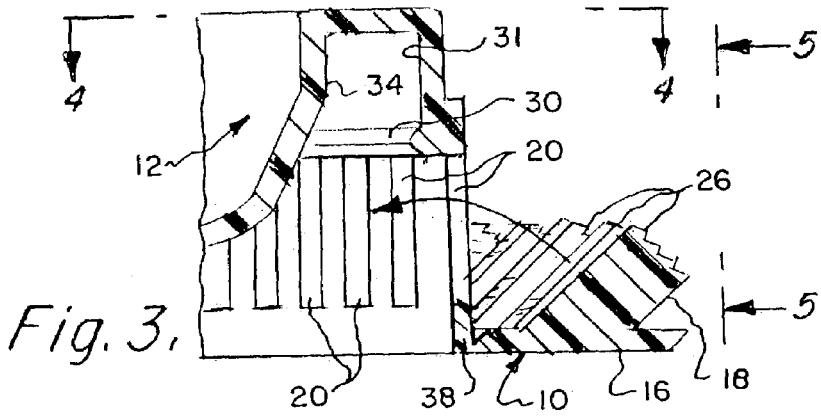
FIG. 3 is a partial sectional view illustrating the mounting of a lid on a container and engagement of the spurs on the tamper evident tear strip.
Figure 4:
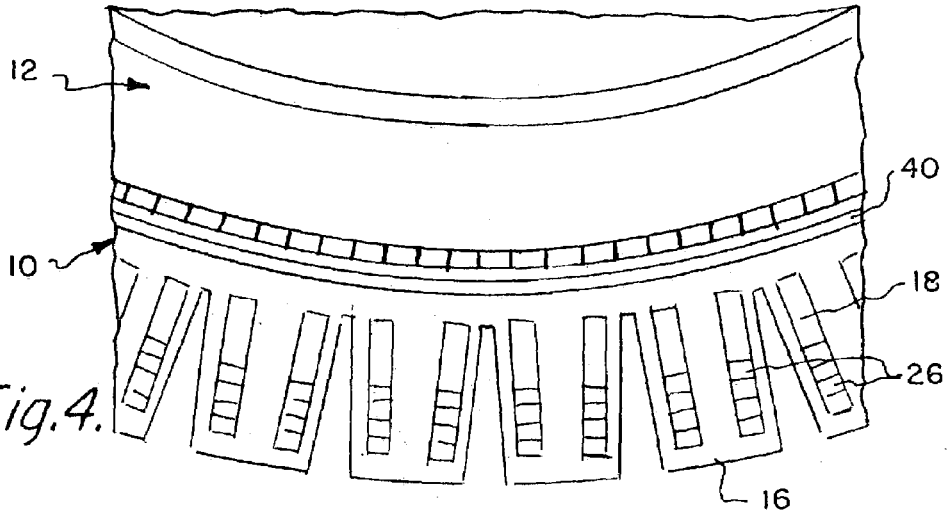
FIG. 4 is a partial sectional view of a lid having a tamper evident tear strip illustrating the appearance of the tear strip on the lid.
Figure 5:
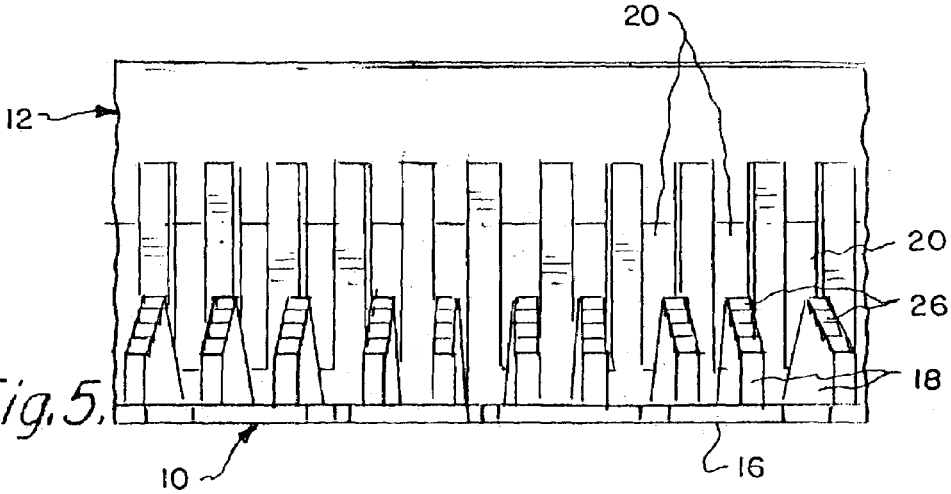
FIG. 5 is a partial view of a lid illustrating the mounting of the lid on a container by upward rotation on the tamper resistant tear strip.

Tamper evident tear strip 10 is secured to lower edge 38 of lid 12 by a thin web of material 40 forming a hinge. FIGS. 3 through 5 illustrate the tear strip 10 partially rolled up into position for mounting the lid on a container. Spurs 18 on tamper evident tear strip 10 engage slots 20 on the lip or skirt of lid 12 as illustrated by the arrow in FIG. 3. When completely mounted on a container 14 as illustrated in FIG. 2, latches formed by steps in section 26 on spurs 18 fit up against ridge 30 in lid beneath flange 28 of container 14. Any attempt to pry lid 12 off of container 14 only serves to tighten the lid on the container because of latches formed by stepped surface 26. Preferably each tab on tamper evident tear strip 10 has two spurs 18. This provides extra security in preventing lid 12 from being removed from container 14 without some evidence of tampering.

Figure 6:
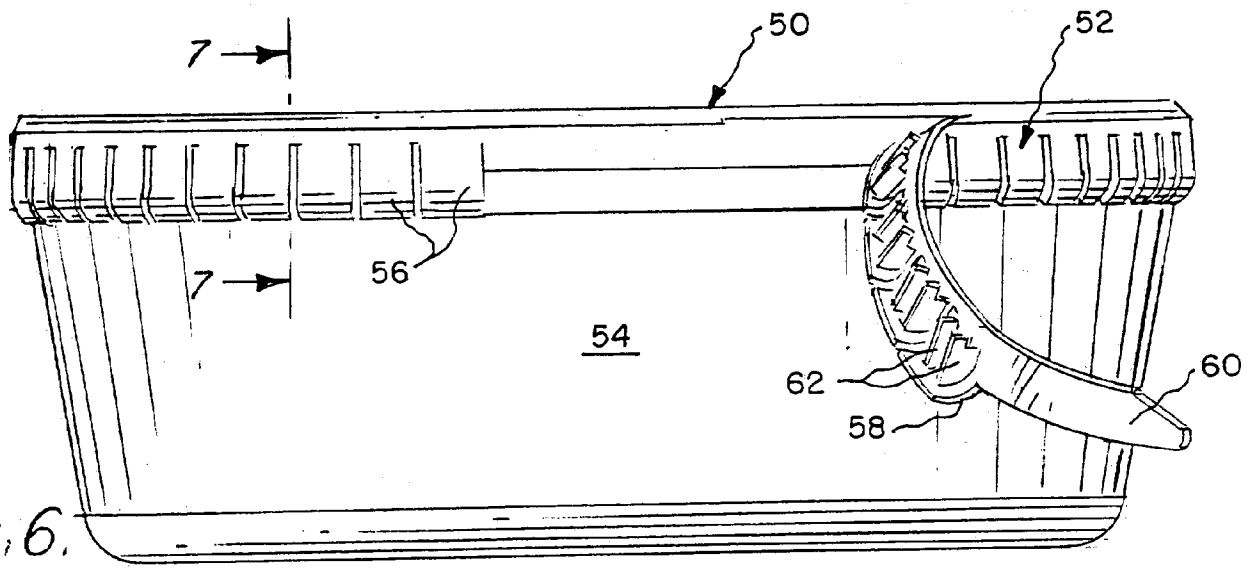
FIG. 6 is a side elevation of a container having a tamper resistant tear strip with a pair of spurs that have a detent that engages the lower edge of a flange on a cup or container to secure the lid and tear strip on the container.

Another embodiment of a tamper evident tear strip construction for mounting a lid on a container is illustrated in FIGS. 6 through 9. A lid 50 having a tamper evident band 52 mounted on a container 54 is illustrated in FIG. 6. Tamper evident band 52 is comprised of a plurality of tabs 56 having a slight curvature indicated at 58 to closely fit against an outer surface of container 54. This arrangement resists any attempt to get under an edge of tamper resistant tear strip. Attempts to pry upwards at curved surface 58 only serves to force tamper resistant tear strip more tightly on container 54. Tamper evident tear strip 52 has a finger-gripping pull tab 60 on the end that allows the band to be stripped from container 52 by a lateral force.

Figure 7:
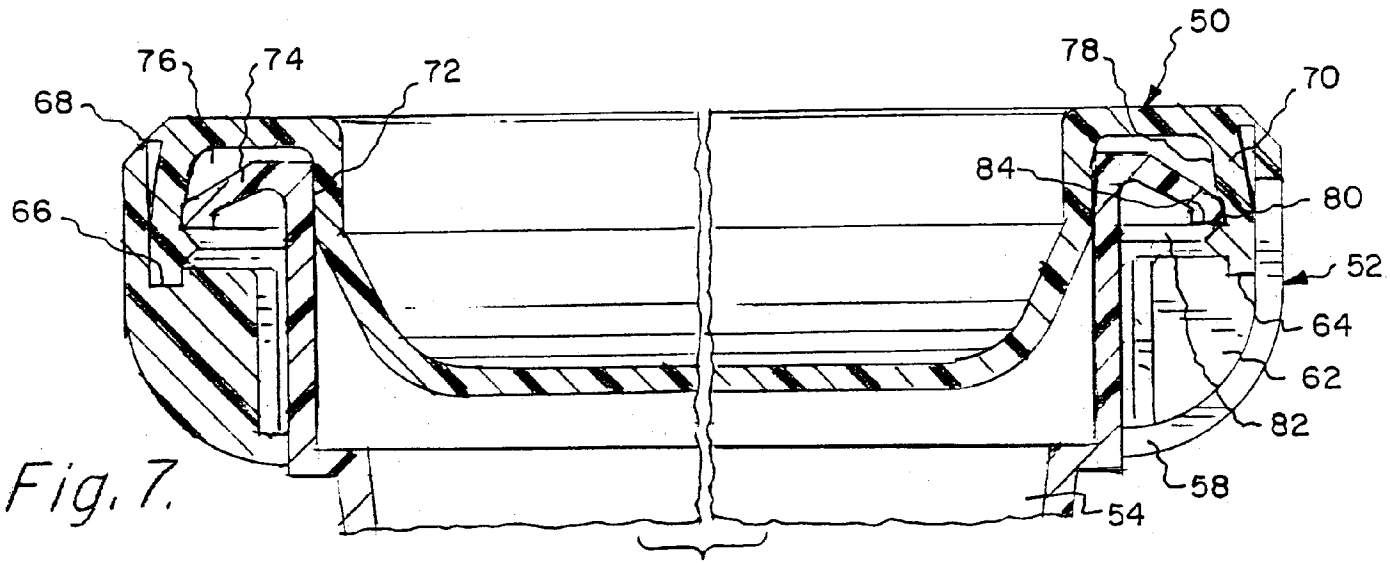
FIG. 7 is a sectional view taken at 7—7 of FIG. 6.

Lid 50 with tamper evident band 52 mounted on container 54 is illustrated in FIG. 7. Spurs or lugs 62 on each tab 56 of tamper evident band 52 have a detent or notch 64 forming a latch that engages the lower peripheral edge 66 of lid 50 to lock the lid on container 54. Each tab 56 preferably has two spurs or lugs 62 to provide extra security in holding lid 50 on container 54. Also tamper evident band 54 is secured to lid 50 by a thin web of material 68 that will easily rupture when a lateral force is applied to finger tab 60.

Lid 50 in this embodiment is also designed with detents or notches 64 in each spur 62 to provide latches to engage the lower edge of skirt 70 around the periphery of lid 50 locking the lid on container 54.

Another unique feature as in the previous embodiment is the lid is constructed to provide a secure seal both inside and outside of the cup or container 54 to provide an effective seal with or without tamper evident band 52. Surface 72 on lid 50 guides flange 74 around the rim of container 54 into annulus 76 beneath skirt or lip 70 on lid 50 providing a secure, tight interior seal. Simultaneously interior surface 78 engages surface 80 on flange 74 of container 54 also providing a secure, tight exterior seal. Ridge 82 engages the lower edge 84 of flange 74 on the securely retaining lid 50 on cup or container 54. Thus the combination of surfaces 72 and 78 in annulus 76 plus ridge 82 serve to provide a very secure seal inside and outside cup 54 with or without tamper resistant strip 52 and retain lid 50 securely on container 54.

Figure 8:
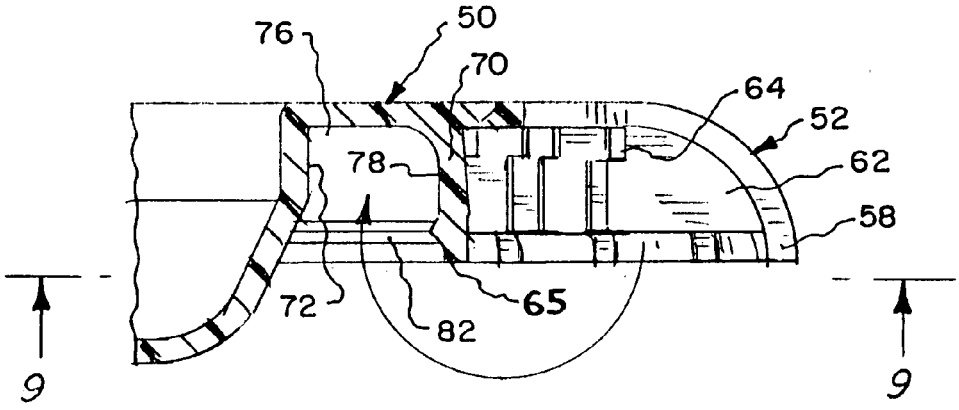
FIG. 8 illustrates the engagement of the tamper evident tear strip when mounting the lid on a cup or container.
Figure 9:
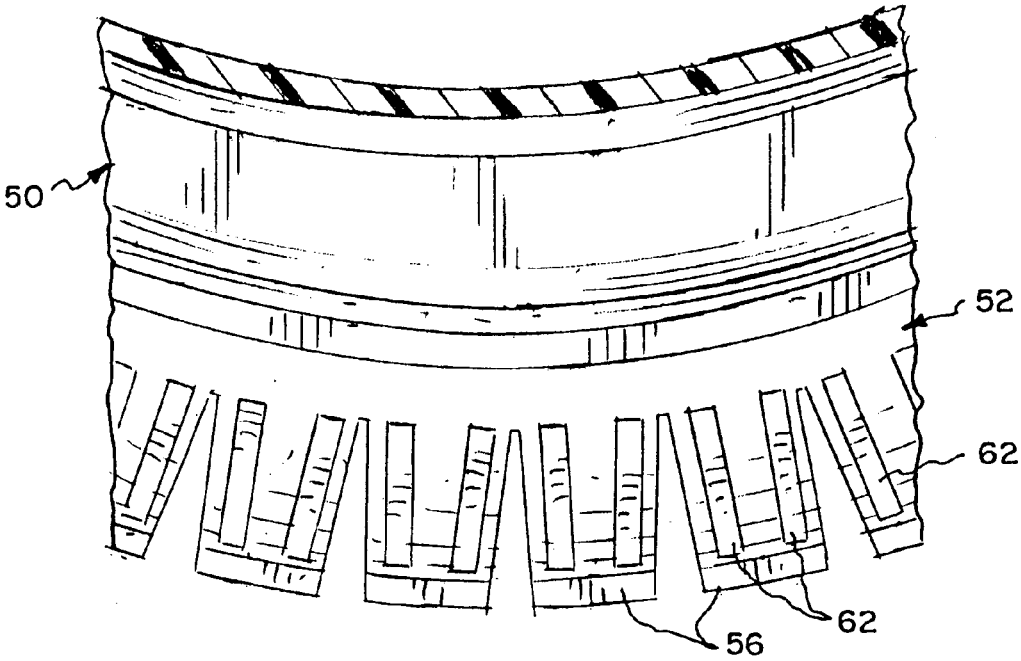
FIG. 9 is a partial sectional view taken at 9—9 of FIG. 8.

The method of mounting lid 50 with tamper evident strip 52 on a container is illustrated in FIGS. 8 and 9. Lid 50 is firmly pressed on cup or container 54 as illustrated in FIG. 7 with surface 72 guiding flange 74 into annulus 76 beneath skirt 70 on lid 50. Tamper evident band or strip 52 is then rolled downward as illustrated by the arrow in FIG. 8 until spurs 62 having latches formed by detents 64 engage lower edge 65 of lip or skirt 70 around the periphery of lid 50 beneath flange 74 on container or cup 54. As shown preferably there are two latches on each tab 56 providing a very secure mounting of lid 50 on cup 54.

Interior surfaces 62 and 78 in annulus 76 beneath skirt 70 of lid 50 provide a very secure seal both inside and outside of cup 54 while ridge 82 acts to retain lid 50 on container 54. The sealing surfaces 72 and 78 are unaffected and are independent of tamper resistant band 52. That is, the secure, tight seal both inside and outside cup 54 is maintained with or without tamper resistant band 52. Because latches 64 on spurs 62 along with the combination of two spurs on each tab 56 securely latch tamper resistant band 52 in place, there is no need for the heat shrinking links between tabs 56 as in the patent referred to hereinabove.

Thus there has been disclosed an improved construction for lids to seal containers with a tamper evident tear strip or band that is both secure and permits an excellent seal both inside and outside the cup when the band is removed. The construction disclosed eliminates the need for additional heat shrinking links between tabs on a tamper resistant band disclosed and described in the patent referred to hereinabove.

In one embodiment, the tamper resistant band has a plurality of tabs having spurs with a stepped edge forming latches that engage a plurality of equally spaced slots in a skirt or lip on the lid. This particular embodiment is unique in that the tamper resistant tear strip hinges up instead of down and protrudes through the sidewall of the skirt on the lid. This reverse action tends to make the container skirt or lip pull the hooks or latches formed by a stepped surface on spurs tighter onto the lid sidewall when an attempt is made to remove it from a cup.

A second embodiment includes a tamper resistant band having a plurality of tabs with spurs on each tab having a detent forming a latch that engages the lower peripheral edge of a skirt around the periphery of the lid. The lower edge of each tab on the tear resistant band is curved to engage the sidewall of the container or cup. Each tab on the tamper resistant band preferably has two spurs with detents forming latches to provide a very secure attachment of lid to the cup or container. As in the previous embodiment, an annulus between the skirt or lip on the lid provides a pair of surfaces that mate with an inside surface of the cup and an outside surface on a flange around the rim of the cup to provide a very secure seal both inside and outside the cup with or without the tamper resistant band.

This invention is not to be limited by the embodiment shown in the drawings and described in the description which is given by way of example and not of limitation, but only in accordance with the scope of the appended claims.

What is claimed is:

1. A tamper resistant lid for containers comprising:

a lid having a peripheral skirt forming an annulus that fits on the rim of a container;

said lid having a plurality of equally spaced slots around said skirt;

a resistant tear strip secured to a peripheral edge of said skirt on said lid by a thin section of material forming a hinge;

said tear strip being hinged on said lid to fold upward;

said tear strip formed of a plurality of tabs;

one or more spurs on each tab constructed to fold beneath a flange around the rim of said container, said spurs being constructed and arranged to engage said slots in said skirt, each of said spurs having a latch mechanism for securely retaining said tamper resistant tear strip on said lid;

whereby said one or more spurs securely holds said lid on said container to protect against tampering with the contents of said container.

2. The tamper resistant lid according to claim 1 in which said one or more spurs comprises at least two of said spurs on each of said tabs.

3. The tamper resistant lid according to claim 2 in which said spurs have a stepped edge forming latches that resist prying said lid off said container.

4. The tamper resistant lid according to claim 3 in which said annulus on said lid has a pair of surfaces that mate with surfaces on said container to provide a secure seal both inside and outside container.

5. The tamper resistant lid according to claim 4 in which one of said pair of surfaces in said annulus mates with an inside surface of said container for guiding said container onto said lid.

6. The tamper resistant lid according to claim 5 in which another of said pair of surfaces in said annulus mates with a surface around a flange on the rim of said container.

7. The tamper resistant lid according to claim 6 in which said another of said pair of surfaces in said annulus includes a peripheral ridge for engaging a lower edge of said flange around said rim of said container for securely locking said lid on said container.

8. The tamper resistant lid according to claim 2 in which said tabs around the periphery of said lid are curved to abut and engage an outer surface of said container when said tamper resistant tear strip is folded down around the rim of said container.

9. The tamper resistant lid according to claim 8 in which there are a pair of spurs formed on each tab of said tamper resistant tear strip, each of said spurs having a latch for engaging a lower peripheral edge of said flange on said container.

* * * * *